US007467918B2

(12) United States Patent
Yao et al.

(10) Patent No.: US 7,467,918 B2
(45) Date of Patent: Dec. 23, 2008

(54) REMOTE CONTROLLED LATCHING SYSTEM

(75) Inventors: Dingxi Yao, Fonthill (CA); Henry A. Lanting, Dunnville (CA)

(73) Assignee: Deere & Company, Moline, IL (US)

( * ) Notice: Subject to any disclaimer, the term of this patent is extended or adjusted under 35 U.S.C. 154(b) by 267 days.

(21) Appl. No.: 11/586,996

(22) Filed: Oct. 26, 2006

(65) Prior Publication Data

US 2008/0101908 A1 May 1, 2008

(51) Int. Cl.
*E02F 3/28* (2006.01)

(52) U.S. Cl. ..... 414/723; 37/468

(58) Field of Classification Search ..... 414/723, 414/699; 37/468; 91/424
See application file for complete search history.

(56) References Cited

U.S. PATENT DOCUMENTS 2,974,637 A * 3/1961 Holmes et al. ..... 137/596.14
6,773,223 B2 * 8/2004 Harris et al. ..... 414/723
7,001,137 B2 * 2/2006 Perrin et al. ..... 414/723

* cited by examiner

*Primary Examiner*—Donald Underwood

(57) ABSTRACT

A remote controlled latching system includes a latch device configured for mating engagement with a connection member to secure an attachment to a carrier; a latching cylinder coupled to the latch device, the latching cylinder having a latched position and an unlatched position; a valve assembly fluidly coupled to the latching cylinder, the valve assembly being configured to selectively drive the latching cylinder into the latched position and the unlatched position; a latching control switch operatively connected to the valve assembly for operating the valve assembly; and a height sensing switch operatively connected to valve assembly for operating the valve assembly.

30 Claims, 4 Drawing Sheets

REMOTE CONTROLLED LATCHING SYSTEM

FIELD OF THE INVENTION

The present invention relates to work machines, and more particularly, to a remote controlled latching system for securing an attachment to a work machine.

BACKGROUND OF THE INVENTION

Work machines such as loaders are used in many industries, including the agricultural, construction, and forestry related industries. Loaders are employed for performing various heavy tasks, such as moving soil, and lifting and moving bales of hay, pallets, and other heavy items. Rather than having a work machine being dedicated to performing only a single task, the versatility of such work machines is enhanced and the cost to the owners reduced by providing various attachments that may be interchangeably fitted onto the work machine so as to allow switching from one task to another. For example, a bucket attachment may be attached to the work machine for picking up and moving soil, whereas for moving hay bundles, the bucket attachment may be removed and replaced with a bale spear.

With many work machines, the task of changing attachments may be quite cumbersome, requiring the operator of the work machine to exit the work machine's cab and physically unlatch and remove one attachment, move the work machine to the location of the next attachment, and exit the work machine's cab to physically attach and then latch the new attachment to the work machine. Since the attachments are typically heavy, e.g., weighing upwards of a couple hundred pounds, it is often difficult to force the latches that secure the mounting of the attachment to the work machine between the latched and unlatched positions. This problem is compounded during cold weather, when the operator may be wearing heavy gloves that make the latching/unlatching task more cumbersome.

In order to reduce the operator workload and time it takes to change attachments, various schemes have been developed that automate the latching and unlatching process. However, such schemes often prove dangerous due to inadvertent operation of the automatic latch/unlatch system which may cause an attachment to become detached unintentionally, resulting in physical harm to the operator or others, and potentially damaging the attachment, the work machine, and/or other equipment.

Hence, it is desirable for a work machine to have a latch/unlatch system that is both safe and simple to use.

SUMMARY OF THE INVENTION

The present invention provides a remote controlled latching system.

The invention, in one form thereof, is directed to a remote controlled latching system for securing an attachment to a work machine. The work machine has a carrier configured for carrying the attachment, a hydraulic bucket cylinder coupled to the carrier, a hydraulic system for providing hydraulic power, and hydraulic lines fluidly coupling the bucket cylinder to the hydraulic system for operating the attachment for performing work with the work machine using the bucket cylinder. The attachment has a connection member for use in the securing the attachment to the work machine. The remote controlled latching system includes a latch device configured for mating engagement with the connection member to secure the attachment to the carrier; a latching cylinder coupled to the latch device, the latching cylinder having a latched position and an unlatched position; a valve assembly fluidly coupled to the latching cylinder, the valve assembly being configured to selectively drive the latching cylinder into the latched position and the unlatched position; a latching control switch operatively connected to the valve assembly for operating the valve assembly; and a height sensing switch operatively connected to valve assembly for operating the valve assembly.

The invention, in another form thereof, is directed to a work machine for performing work with an attachment, the attachment having a connection member for use in securing the attachment to the work machine. The work machine includes a carrier configured for carrying the attachment; a hydraulic bucket cylinder coupled to the carrier; a hydraulic system for providing hydraulic power; hydraulic lines fluidly coupling the bucket cylinder to the hydraulic system for operating the attachment for performing work with the work machine using the bucket cylinder; and a remote controlled latching system for securing the attachment to the carrier using the connection member. The remote controlled latching system includes a latch device configured for mating engagement with the connection member to secure the attachment to the carrier; a latching cylinder coupled to the latch device, the latching cylinder having a latched position and an unlatched position; a valve assembly fluidly coupled to the latching cylinder, the valve assembly being configured to selectively drive the latching cylinder into the latched position and the unlatched position; a latching control switch operatively connected to the valve assembly for operating the valve assembly; and a height sensing switch operatively connected to valve assembly for operating the valve assembly.

DETAILED DESCRIPTION OF THE INVENTION

Figure 1:
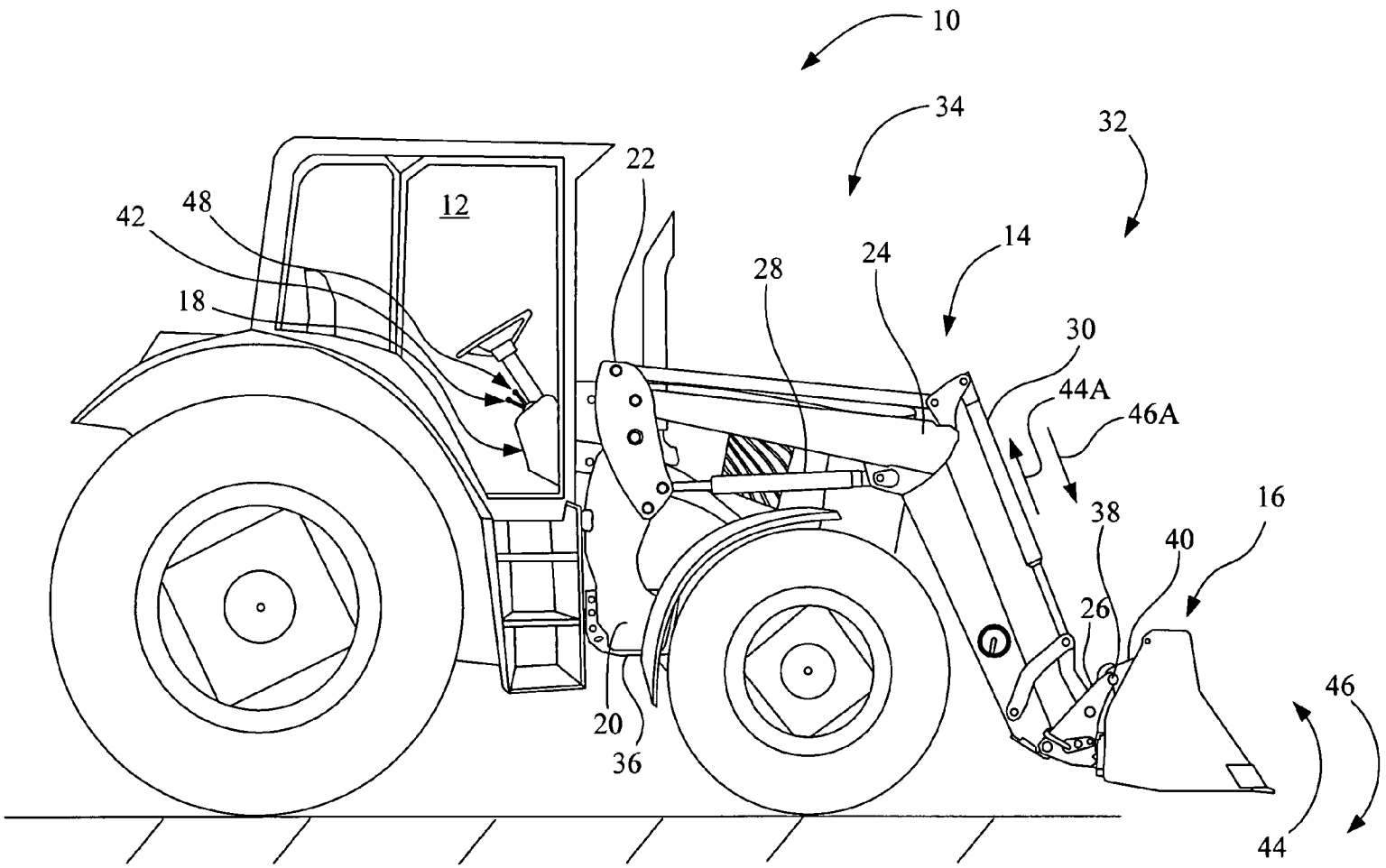
FIG. 1 depicts a work machine employed in accordance with an embodiment of the present invention.

Referring now to FIG. 1, there is shown a work machine 10 in accordance with an embodiment of the present invention. Work machine 10 may be used for performing agricultural, construction, and/or forestry work, and may be wheel driven and/or track driven. In the present embodiment, work machine 10 is a wheel driven loader.

Work machine 10 includes a cab 12, and a work system 14 for operating an attachment 16. Attachment 16 is an interchangeable implement designed for performing particular tasks. In the embodiment of FIG. 1, attachment 16 is depicted as a bucket. However, it will be understood that attachment 16 may be any typical interchangeable loader attachment used in, for example, the agricultural, construction, and forestry industries, such as bale forks, bale spears, pallet forks, a multi-function bucket, a round bale hugger, a debris grapple bucket, or a silage defacer.

Located in cab 12 is a control console 18 for operating work system 14. Cab 12 houses the operator of work machine 10 while operating work machine 10.

Work system 14 includes, on each side of work machine 10, a mounting frame 20, a mast 22, a boom 24, a carrier 26, a lift cylinder 28, a bucket cylinder 30, a remote controlled latching system 32, and a hydraulic system 34 for providing hydraulic power to operate work system 14.

Mounting frame 20 is affixed to a frame 36 of work machine 10. Mast 22 is affixed to and extends from mounting frame 20. Boom 24 is movably connected to mast 22, and carrier 26 is rotatably attached to boom 24. Carrier 26 is configured to carry attachment 16, and accordingly includes two pins 38 that engage corresponding hooks 40 on attachment 16 for carrying attachment 16. The primary downward vertical loads associated with the operation of attachment 16 are transferred to carrier 26 via hooks 40 and pins 38. Attachment 16 is secured to carrier 26 using remote controlled latching system 32, which prevents pins 38 and hooks 40 from disengaging.

Lift cylinder 28 is coupled to both mast 22 and boom 24, and via hydraulic power from hydraulic system 34, is used to raise and lower boom 24, and hence carrier 26 with attachment 16. Lift cylinder 28 is controlled by the operator of work machine 10 using a control device, such as lever 42 located in cab 12. Bucket cylinder 30 is coupled to both boom 24 and carrier 26, and via hydraulic power from hydraulic system 34, is used to rotate carrier 26, and hence, attachment 16, in a roll back direction 44 and a dump direction 46. Carrier 26 rotation in roll back direction 44 results from bucket cylinder movement in roll back direction 44A (retraction of bucket cylinder 30), and carrier 26 rotation in dump direction 46 results from bucket cylinder movement in dump direction 46A (extension of bucket cylinder 30). Bucket cylinder 30 is controlled by the operator of work machine 10 using a control device, such as lever 48 located in cab 12. It will be noted that bucket cylinder 30 is so named because many work machine owners/operators commonly use an attachment 16 in the form of a bucket, as is depicted in FIG. 1, and hence, the hydraulic cylinder that is used to rotate carrier 26 has become known in the art as a "bucket cylinder." However, it will be understood that the term, "bucket cylinder," pertains to the hydraulic cylinder used to rotate carrier 26, without regard to the type of attachment 16 used with work machine 10.

Figure 2:
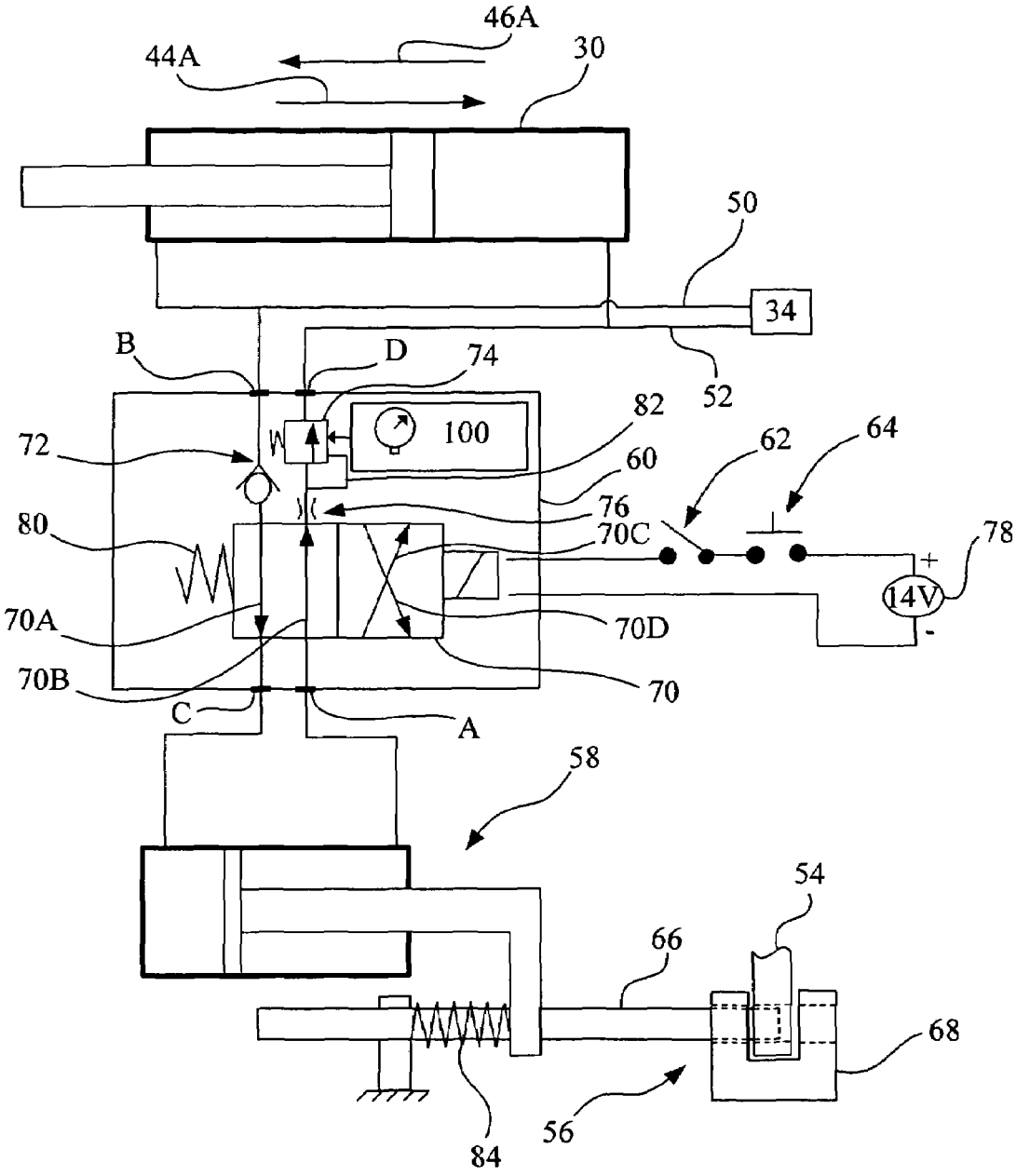
FIG. 2 is a schematic depicting a remote controlled latching system 32 in accordance with an embodiment of the present invention.

Referring now to FIG. 2, the remote controlled latching system 32 in accordance with an embodiment of the present invention is shown schematically. As depicted in FIG. 2, work machine 10 includes hydraulic lines 50 and 52 that couple bucket cylinder 30 with hydraulic system 34 for operating attachment 16 for performing work with work machine 10 using bucket cylinder 30. Attachment 16 includes a connection member 54, in the form of a lug, for use in securing attachment 16 to work machine 10.

Remote controlled latching system 32 includes a latching device 56, a latching cylinder 58, a valve assembly 60 in the form of a diverter valve, a latching control switch 62, and a height sensing switch 64. Latching device 56 is configured for mating engagement with connection member 54 to secure attachment to carrier 26. In the present embodiment, latching device 56 is a pin 66 and a corresponding clevis 68 located on each side of carrier 26. Clevis 68 is affixed to carrier 26; whereas pin 66 is slidably coupled to and retained on carrier 26 such that pin 66 may slide into and out of clevis 68. It will be understood that latching device 56 may take other forms without departing from the scope of the present invention. For example, latching device 56 may take the form of one or more wedges and corresponding grooves. In any case, latching device 56 and connection member 54 are jointly configured for mating engagement to secure attachment 16 to carrier 26.

Latching cylinder 58 has a latched position and an unlatched position, and is coupled to pin 66 of latching device 56. When latching cylinder 58 is in the latched position, pin 66 fully engages clevis 68 to retain connection member 54 in mating engagement with latching device 56, thus securing attachment 16 to carrier 26. When latching cylinder 58 is in the unlatched position, pin 66 is withdrawn from clevis 68 to a degree sufficient to allow the connection member 54 of attachment 16 to freely move in or out of clevis 68. In FIG. 2, latching cylinder 58 is depicted in an arbitrary position between the latched and unlatched positions.

Valve assembly 60 is fluidly interposed between hydraulic lines 50, 52 and latching cylinder 58 for operating latching cylinder 58 based on hydraulic pressure in hydraulic lines 50. Hydraulic line 50 is a bucket cylinder retraction line (roll back direction), i.e., it provides hydraulic flow/pressure to retract bucket cylinder 30, whereas hydraulic line 52 is a bucket cylinder extension line, which provides hydraulic flow/pressure to extend bucket cylinder (dump direction). Valve assembly 60 diverts hydraulic flow/pressure from bucket cylinder 30 via hydraulic lines 50 to operate remote controlled latching system 32, and hence, is referred to as a diverter valve.

Valve assembly 60 includes a solenoid valve 70, a check valve 72, a relief valve 74, an orifice 76, and ports A, B, C, and D. Valve assembly 60 is fluidly coupled to latching cylinder 58, and is configured to selectively drive latching cylinder 58 into the latched position and the unlatched position based on the pressure in hydraulic line 50, e.g., depending on whether the operator of work machine 10 wishes to latch or unlatch attachment 16. Port B is an inlet port for receiving hydraulic flow/pressure from hydraulic line 50 for operating latching cylinder 58. Port D is for exhausting hydraulic fluid from latching cylinder 58 into hydraulic line 52, and ports C and A direct hydraulic fluid to the head end and rod end of latching cylinder 58, respectively. Electrical power is provided to valve assembly 60 by work machine 10, e.g., via a 14-Volt electrical power system 78, which is used to operate solenoid valve 70.

Solenoid valve 70 includes latching passages 70A and 70B, and includes unlatching passages 70C and 70D. Solenoid valve 70 has a default position that maintains latching cylinder 58 in the latched position. In the present embodiment, solenoid valve 70 is biased into the default position by a spring 80, thus directing hydraulic pressure from hydraulic line 50 to maintain latching cylinder 58 in the latched position. Solenoid valve 70 is only actuated to drive latching cylinder 58 into the latched position if both latching control switch 62 and height sensing switch 64 are closed.

Check valve 72 is interposed between inlet port B and latching cylinder 58, and is configured to prevent hydraulic flow from exiting latching cylinder 58 via inlet port B. Relief valve 74 is pilot operated via a pilot passage 82, and prevents hydraulic flow from exiting port D of valve assembly 60 unless the pressure upstream of relief valve 74 exceeds a predetermined pressure setting. In the example of the present embodiment, the predetermined pressure setting is 100 bar. Thus, relief valve 74 prevents latching cylinder 58 from exiting latched position and from exiting the unlatched position when the hydraulic pressure is below the predetermined pressure setting. Orifice 76 restricts the flow of hydraulic fluid through valve assembly 60 in order to prevent overly rapid movement of latching cylinder 58.

Latching control switch 62 and height sensing switch 64 are operatively connected to valve assembly 60 for operating valve assembly 60 to latch and unlatch attachment 16. Latching control switch 62 is a hand operated normally open momentary switch, and is mounted in such a manner as to require the operator of work machine 10 to use two hands to operate both lever 48 and latching control switch 62. By requiring two handed operation, safety is enhanced, in that it is less likely that an operator will inadvertently cause valve assembly 60 to unlatch attachment 16. In the present embodiment, latching control switch is located on control console 18. Height sensing switch 64 is configured to prevent actuation of valve assembly 60 when carrier 26 is above a predetermined height, e.g., 2 feet off the ground for the present embodiment. Valve assembly 60 is configured to drive latching cylinder 58 into the unlatched position only when both latching control switch 62 height sensing switch 64 are closed.

The operation of remote controlled latching system 32 is described below with respect to FIGS. 3 and 4. From the following description, it will be understood that valve assembly 60 is configured to selectively drive latching cylinder 58 into the latched position and the unlatched position only when bucket cylinder 30 is operated in roll back direction 44A and has reached the maximum limit in the roll back direction 44A. Valve assembly 60 is electrically operated, and configured to operate only when work machine 10 is running. In addition, as set forth below, valve assembly 60 is configured to selectively drive latching cylinder 58 into the latched position and the unlatched position based on the pressure in said hydraulic line 50 exceeding a predetermined pressure setting.

Figure 3:
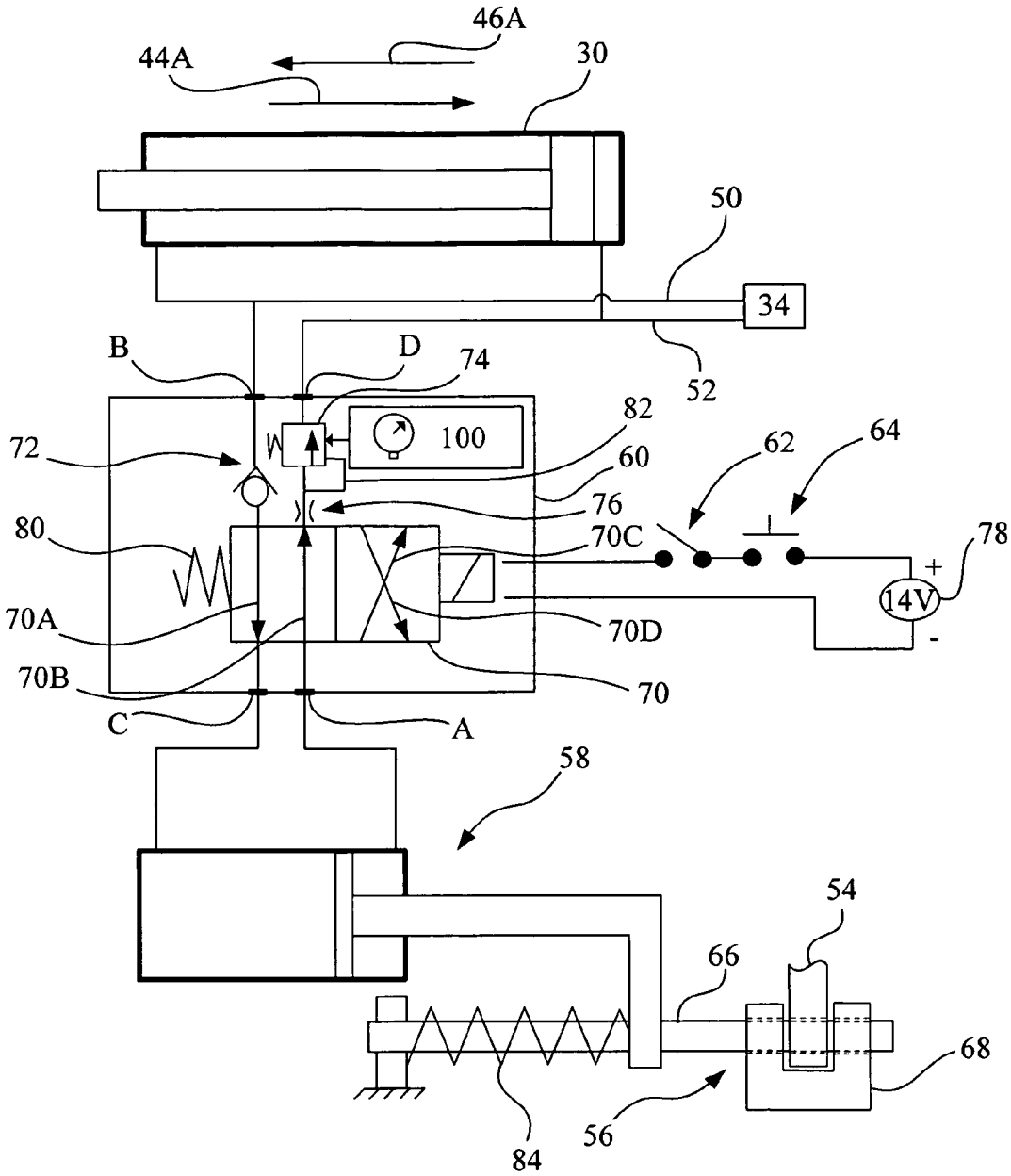
FIG. 3 depicts the remote controlled latching system 32 of FIG. 2 wherein a latching cylinder is in a latched position.

Referring now to FIG. 3, the operation of remote controlled latching system 32 for placing latching cylinder 58 in the latched position is described.

In order to place latching cylinder 58 into the latched position, the operator of work machine 10 moves lever 48 to cause bucket cylinder 30 to move in direction 44A, which increases pressure in hydraulic line 52. Once bucket cylinder 30 bottoms out in the retracted position, the pressure in hydraulic line 52 increases. When the pressure at relief valve 74 exceeds the predetermined pressure setting, hydraulic flow enters port B, flows through check valve 72 and latching passage 70A, and enters the head end of latching cylinder 58, driving latching cylinder 58 into the latched position. Hydraulic flow from the rod end of latching cylinder 58 is exhausted from latching cylinder 58 into port A of valve assembly 60, and proceeds through latching passage 70B, orifice 76, relief valve 74, and port D, to return via hydraulic line 52 to hydraulic system 34.

Check valve 72 provides a safety function by preventing backflow through port B. Thus, once latching cylinder is in the latched position, it is retained in the latched position until valve assembly 60 is operated to drive latching cylinder 58 into the unlatched position regardless of bucket function operation. Since solenoid valve 70 defaults to the position illustrated in FIG. 3, latching cylinder 58 is retained in the latched position even if electrical power system 78 is turned off. In addition, check valve 72 retains latching cylinder 58 in the latched position in the event of a failure of hydraulic system 34 or hydraulic line 52, since hydraulic fluid from the head side of latching cylinder 58 cannot exit valve assembly 60 via inlet port B.

Additional safety is provided by a spring 84 that biases latching cylinder 58 to the latched position. Also, even given a failure of hydraulic system 34 and/or hydraulic lines 50 and 52, if valve assembly were inadvertently actuated, the head side of latching cylinder 58 would not be able to drain via unlatching passage 70C through port D of valve assembly 60, since there would be insufficient pressure to overcome relief valve 74, and hence, latching cylinder 58 would be retained in the latched position, reducing the likelihood of an inadvertent detachment of attachment 16 from carrier 26.

Figure 4:
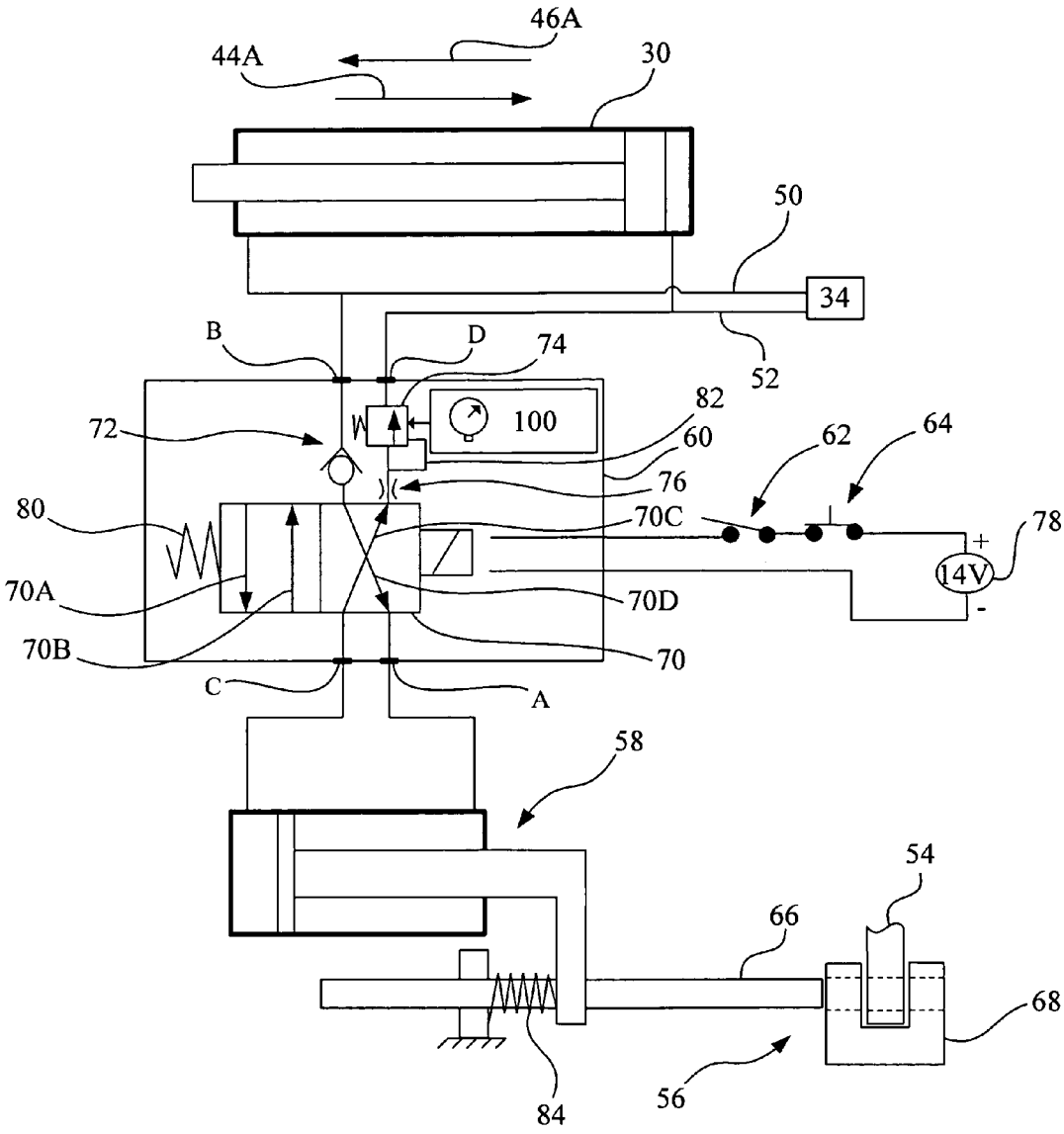
FIG. 4 depicts the remote controlled latching system 32 wherein the latching cylinder is in an unlatched position.

Referring now to FIG. 4, the operation of remote controlled latching system 32 for placing latching cylinder 58 in the unlatched position is described, which may only be performed if carrier 26 is within the predetermined height required to close height sensing switch 64.

In order to place latching cylinder 58 into the unlatched position, the operator of work machine 10 moves lever 48, using one hand, to cause bucket cylinder 30 to move in direction 44A, which increases pressure in hydraulic line 50. In addition, the operator uses the other hand to push latching control switch 62, closing its contacts. Because latching control switch 62 is a momentary switch, the operator's hand must be kept on the switch during the unlatching operation, which provides a safety benefit in that it is less likely that an unlatching operation would be accidentally performed. With latching control switch 62 and height sensing switch 64 closed, solenoid valve 70 is operated to move out of the default position against the bias of spring 80, bringing unlatching passages 70C and 70D into alignment with ports A, B, C, and D.

Once bucket cylinder 30 bottoms out in the retracted position, the pressure in hydraulic line 50 increases. Relief valve 74 prevents latching cylinder 58 from moving to the unlatched position unless bucket cylinder 30 is driven to the maximum limit in roll back direction 44A, which causes a substantial increase in hydraulic pressure beyond that which would occur when bucket cylinder 30 is not bottomed out. By selecting the predetermined pressure setting of relief valve 74 accordingly, the likelihood of an inadvertent unlatching operation is reduced.

When the pressure at relief valve 74 exceeds the predetermined pressure setting, hydraulic fluid enters port B, flows through check valve 72 and unlatching passage 70D, and enters the rod end of latching cylinder 58, driving latching cylinder 58 into the unlatched position. Hydraulic flow from the head end of latching cylinder 58 is exhausted from latching cylinder 58 into port C of valve assembly 60, and proceeds through unlatching passage 70C, orifice 76, relief valve 74, and port D, to return via hydraulic line 52 to hydraulic system 34. If at any time during the unlatching operation carrier 16 is raised above the predetermined height, height sensing switch 64 will be placed into an open state, wherein bias spring 80 will move solenoid valve 70 to the default position, thus driving latching cylinder 58 into the latched position. Similarly, if at any time during the unlatching operation the operator's hand is removed from latching control switch 62, latching control switch 62 will spring into an open state, wherein bias spring 80 will move solenoid valve 70 to the default position, thus driving latching cylinder 58 into the latched position.

Having described the preferred embodiment, it will become apparent that various modifications can be made without departing from the scope of the invention as defined in the accompanying claims.

The invention claimed is:

1. A remote controlled latching system for securing an attachment to a work machine, said work machine having a carrier configured for carrying said attachment, a hydraulic bucket cylinder coupled to said carrier, a hydraulic system for providing hydraulic power, and hydraulic lines fluidly coupling said bucket cylinder to said hydraulic system for operating said attachment for performing work with said work machine using said bucket cylinder, said attachment having a connection member for use in said securing said attachment to said work machine, said remote controlled latching system comprising:

a latch device configured for mating engagement with said connection member to secure said attachment to said carrier;

a latching cylinder coupled to said latch device, said latching cylinder having a latched position and an unlatched position;

a valve assembly fluidly coupled to said latching cylinder, said valve assembly being configured to selectively drive said latching cylinder into said latched position and said unlatched position;

a latching control switch operatively connected to said valve assembly for operating said valve assembly; and a height sensing switch operatively connected to valve assembly for operating said valve assembly.

2. The remote controlled latching system of claim 1, wherein said height sensing switch is configured to prevent actuation of said valve assembly when said carrier is above a predetermined height.

3. The remote controlled latching system of claim 1, wherein said valve assembly is configured to drive said latching cylinder into said unlatched position only when both said latching control switch and said height sensing switch are closed.

4. The remote controlled latching system of claim 1, said valve assembly including a valve, wherein a default position of said valve maintains said latching cylinder in said latched position.

5. The remote controlled latching system of claim 1, said bucket cylinder being operable in a first direction and a second direction, wherein said valve assembly is configured to selectively drive said latching cylinder into said latched position and said unlatched position only when said bucket cylinder is operated in said first direction.

6. The remote controlled latching system of claim 5, wherein said valve assembly is configured to selectively drive said latching cylinder into said latched position and said unlatched position only when said bucket cylinder is positioned at a maximum limit in said first direction.

7. The remote controlled latching system of claim 1, said valve assembly including a relief valve configured to prevent said latching cylinder from exiting said latched position and from exiting said unlatched position below a predetermined pressure setting of said relief valve.

8. The remote controlled latching system of claim 1, said valve assembly including an inlet port for receiving hydraulic pressure for operating said latching cylinder, and said valve assembly having a check valve interposed between said inlet port and said latching cylinder, said check valve being configured to prevent hydraulic flow from exiting said latching cylinder via said inlet port.

9. The remote controlled latching system of claim 1, wherein said latching control switch is a momentary switch.

10. The remote controlled latching system of claim 9, wherein said latching control switch is a hand-operated momentary switch.

11. The remote controlled latching system of claim 1, wherein a first control device is employed to operate said bucket cylinder, and wherein said latching control switch is configured to require two-handed operation to engage both said first control device and said latching control switch.

12. The remote controlled latching system of claim 1, wherein said valve assembly is electrically operated, and wherein said valve assembly is configured to operate only when said work machine is running.

13. The remote controlled latching system of claim 1, said valve assembly being fluidly interposed between said hydraulic lines and said latching cylinder for operating said latching cylinder based on hydraulic pressure in said hydraulic lines.

14. The remote controlled latching system of claim 13, said hydraulic lines including a bucket cylinder retraction line, said valve assembly being configured to selectively drive said latching cylinder into said latched position and said unlatched position based on a pressure in said bucket cylinder retraction line.

15. The remote controlled latching system of claim 14, said valve assembly being configured to selectively drive said latching cylinder into said latched position and said unlatched position based on said pressure in said bucket cylinder retraction line exceeding a predetermined pressure setting.

16. A work machine for performing work with an attachment, said attachment having a connection member for use in securing said attachment to said work machine, said work machine comprising:

a carrier configured for carrying said attachment;

a hydraulic bucket cylinder coupled to said carrier;

a hydraulic system for providing hydraulic power;

hydraulic lines fluidly coupling said bucket cylinder to said hydraulic system for operating said attachment for performing work with said work machine using said bucket cylinder; and a remote controlled latching system for securing said attachment to said carrier using said connection member, said remote controlled latching system including:

a latch device configured for mating engagement with said connection member to secure said attachment to said carrier;

a latching cylinder coupled to said latch device, said latching cylinder having a latched position and an unlatched position;

a valve assembly fluidly coupled to said latching cylinder, said valve assembly being configured to selectively drive said latching cylinder into said latched position and said unlatched position;

a latching control switch operatively connected to said valve assembly for operating said valve assembly; and a height sensing switch operatively connected to valve assembly for operating said valve assembly.

17. The work machine of claim 16, wherein said height sensing switch is configured to prevent actuation of said valve assembly when said carrier is above a predetermined height.

18. The work machine of claim 16, wherein said valve assembly is configured to drive said latching cylinder into said unlatched position only when both said latching control switch and said height sensing switch are closed.

19. The work machine of claim 16, said valve assembly including a valve, wherein a default position of said valve maintains said latching cylinder in said latched position.

20. The work machine of claim 16, said bucket cylinder being operable in a first direction and a second direction, wherein said valve assembly is configured to selectively drive said latching cylinder into said latched position and said unlatched position only when said bucket cylinder is operated in said first direction.

21. The work machine of claim 20, wherein said valve assembly is configured to selectively drive said latching cylinder into said latched position and said unlatched position only when said bucket cylinder is positioned at a maximum limit in said first direction.

22. The work machine of claim 16, said valve assembly including a relief valve configured to prevent said latching cylinder from exiting said latched position and from exiting said unlatched position below a predetermined pressure setting of said relief valve.

23. The work machine of claim 16, said valve assembly including an inlet port for receiving hydraulic pressure for operating said latching cylinder, and said valve assembly having a check valve interposed between said inlet port and said latching cylinder, said check valve being configured to prevent hydraulic flow from exiting said latching cylinder via said inlet port.

24. The work machine of claim 16, wherein said latching control switch is a momentary switch.

25. The work machine of claim 24, wherein said latching control switch is a hand-operated momentary switch.

26. The work machine of claim 16, wherein a first control device is employed to operate said bucket cylinder, and wherein said latching control switch is configured to require two-handed operation to engage both said first control device and said latching control switch.

27. The work machine of claim 16, wherein said valve assembly is electrically operated, and wherein said valve assembly is configured to operate only when said work machine is running.

28. The work machine of claim 16, said valve assembly being fluidly interposed between said hydraulic lines and said latching cylinder for operating said latching cylinder based on hydraulic pressure in said hydraulic lines.

29. The work machine of claim 28, said hydraulic lines including a bucket cylinder retraction line, said valve assembly being configured to selectively drive said latching cylinder into said latched position and said unlatched position based on a pressure in said bucket cylinder retraction line.

30. The work machine of claim 29, said valve assembly being configured to selectively drive said latching cylinder into said latched position and said unlatched position based on said pressure in said bucket cylinder retraction line exceeding a predetermined pressure setting.

* * * * *